US008656561B2

(12) United States Patent
Ingels

(10) Patent No.: US 8,656,561 B2
(45) Date of Patent: Feb. 25, 2014

(54) RELEASABLE BUTTON FOR FABRICS AND CLOTHING

(76) Inventor: Jonkeo Doungdeth Ingels, New York City, NY (US)

( * ) Notice: Subject to any disclaimer, the term of this patent is extended or adjusted under 35 U.S.C. 154(b) by 696 days.

(21) Appl. No.: 12/861,579

(22) Filed: Aug. 23, 2010

(65) Prior Publication Data

US 2012/0042480 A1 Feb. 23, 2012

(51) Int. Cl.
*A44B 1/28* (2006.01)

(52) U.S. Cl.
USPC ..... 24/104; 24/103; 24/657; 24/707.6; 24/705; 24/595.1

(58) Field of Classification Search
USPC ..... 24/103, 657, 705, 707.6, 595.1, 104; 63/12, 13
See application file for complete search history.

(56) References Cited

U.S. PATENT DOCUMENTS

| | | | | |
|---|---|---|---|---|
| 272,968 | A | 2/1883 | McKevit | |
| 390,162 | A | 9/1888 | Glass | |
| 409,115 | A | 8/1889 | Patton | |
| 1,187,931 | A | 6/1916 | Rovelli | |
| 1,265,869 | A * | 5/1918 | Arkin | 24/657 |
| 1,305,979 | A * | 6/1919 | Cobe | 24/657 |
| 1,531,757 | A * | 3/1925 | Rogers, Jr. | 24/110 |
| 2,308,412 | A * | 1/1943 | Ballou, Jr. et al. | 24/707.5 |
| 2,584,828 | A | 2/1952 | Ballou, Jr. | |
| 2,732,603 | A | 1/1956 | Morehouse | |
| 2,861,312 | A | 11/1958 | Buchwald et al. | |
| 3,311,958 | A * | 4/1967 | Reeves | 24/707.6 |
| 3,892,014 | A | 7/1975 | Nolan | |
| 4,035,874 | A | 7/1977 | Liljendahl | |
| 4,425,687 | A | 1/1984 | Sauer | |
| 4,507,344 | A | 3/1985 | Baughman | |
| 4,571,136 | A | 2/1986 | Peek | |
| 4,662,034 | A | 5/1987 | Cunningham | |
| 5,154,068 | A | 10/1992 | DiDomenico | |
| 5,426,828 | A | 6/1995 | Kusano | |

(Continued)

FOREIGN PATENT DOCUMENTS

| | | |
|---|---|---|
| FR | 1 577 659 | 8/1969 |
| GB | 04805 | 0/1913 |

OTHER PUBLICATIONS

"Singer Button Magic Easy No-sew Repair Kit";http://www.oyerstock.com/Crafts-Sewing/Singer-Button-Magic-Easy-No-sew-Repair-Kit/3485420/product.html Retrieved on Dec. 3, 2010.
"Pinmart"; http://pinmart.com/Retrieved on Dec. 3, 2010.
"1Stitch";http://www.allbrands.com/products/abp25750.html Retrieved on Dec. 3, 2010.

(Continued)

*Primary Examiner* — Robert J Sandy
(74) *Attorney, Agent, or Firm* — Wolff & Samson, PC

(57) ABSTRACT

An apparatus for replacing a button is provided having a pin and a base. The pin includes a head and a stem attached to, and substantially perpendicular to, the head. The base includes a case having a cavity defined by a top surface including an opening for receiving the stem and a side surface coupled to the top surface. A mechanism for securing the pin within the case includes one or two springs, configured to releasably engage a ridged portion of the stem of the pin. The depth of insertion of the pin into the case is controlled by the engagement of the pin and the springs, a solid bottom surface of the case, and a flange on the stem that engages the top surface of the case at a desired depth.

9 Claims, 3 Drawing Sheets

(56) References Cited

U.S. PATENT DOCUMENTS

| | | | |
|---|---|---|---|
| 5,490,309 | A | 2/1996 | Velasquez et al. |
| 5,603,143 | A | 2/1997 | Rucker |
| 5,893,278 | A | 4/1999 | Float et al. |
| 6,389,662 | B1 | 5/2002 | Hamm, Jr. |
| 6,557,220 | B1 | 5/2003 | Hamm, Jr. |
| 6,612,131 | B2 | 9/2003 | Cheng |
| 7,089,634 | B1 | 8/2006 | Dunning |
| 2006/0000062 | A1 | 1/2006 | Berlfein |

OTHER PUBLICATIONS http://www.iaspromotes.com/scat/413/IDENTIFICATION-(Badges-Buttons-Pins-etc..)/Lapel-Pins.htm Retrieved on Dec. 3, 2010.

PCT International Search Report corresponding to PCT Application No. PCT/US2010/003057 filed Nov. 29, 2010 (3 pages).

PCT Written Opinion of the International Searching Authority corresponding to PCT Application No. PCT/US2010/003057 filed Nov. 29, 2010 (7 pages).

* cited by examiner

RELEASABLE BUTTON FOR FABRICS AND CLOTHING

FIELD OF THE INVENTION

The present invention is generally directed to a fastener, and more particularly to a releasable button for use with clothing and other fabrics.

BACKGROUND

Buttons on garments, such as shirts, frequently break or fall off due to deterioration of the stitching, thus requiring the wearer to replace the button. Replacing a button by sewing a replacement to the garment requires time and skill, which many consumers do not possess. Additionally, buttons on garments are frequently used as an ornamental aspect of the design. However, once a button is sewn on to a garment, the ornamental aspect of the button is substantially fixed and cannot be interchanged or replaced without removing the button and sewing on a different button.

SUMMARY OF THE INVENTION

In accordance with an embodiment of the present invention, an apparatus for replacing a button of a shirt includes a pin and a base configured to receive the pin. The pin comprises a head configured to engage a buttonhole of the shirt, and a stem attached to the head and configured to pass through a fabric of the shirt. Within the base is a mechanism for releasably securing the pin.

In accordance with a further embodiment of the present invention, an apparatus is provided having a pin and a base. The pin comprises a head and a stem attached to, and substantially perpendicular to, the head. The base comprises a case having a cavity defined by a top surface including an opening for receiving the stem and a side surface coupled to the top surface. Within the cavity of the case is a first spring coupled to the case and configured to secure the stem within the cavity of the case.

In yet a further aspect of the present invention, the apparatus comprises a second spring within the cavity of the case. The second spring is coupled to the case and configured to secure the stem within the cavity of the case between the first spring and the second spring. The stem of the pin can include a ridged portion that is engaged by the first and second spring to secure the spring. Each spring is coupled to a release button, which when displaced, disengages the springs from the pin.

In accordance with a further aspect of an embodiment of the present invention, the depth of insertion of the pin into the case is controlled. The depth can be controlled by the engagement of the pin by the springs. Alternatively, the depth can be controlled by a solid bottom surface of the case, which prevents the stem from passing through the bottom surface. In yet a further alternative, the pin can include a flange which engages the top surface of the case to control the depth of insertion.

These and other advantages of the invention will be apparent to those of ordinary skill in the art by reference to the following Detailed Description and the accompanying drawings.

DETAILED DESCRIPTION

The present invention is directed to a releasable fastener. The fastener can be used, for example, as a button on a shirt or other article of clothing, but is not limited to applications concerning a garment. For example, a device or apparatus in accordance with an embodiment of the present invention can be used beyond the need to secure a garment. Such a device can be used as an accessory, such as a cufflink, or affixed anywhere (e.g., shirt, pants, hat, bag, etc.) as a decoration or ornamental accessory. In accordance with a particular use, the fastener can be a quick replacement for a button that has been lost or removed. Alternatively, the fastener can be used as design element of an original garment or as a substitute for other customarily sewn buttons. While the discussion below refers to the fastener as a button, a person of ordinary skill in the art would understand that the faster is not limited to applications of a button, but is applicable to a variety of uses and applications.

Figure 1A:
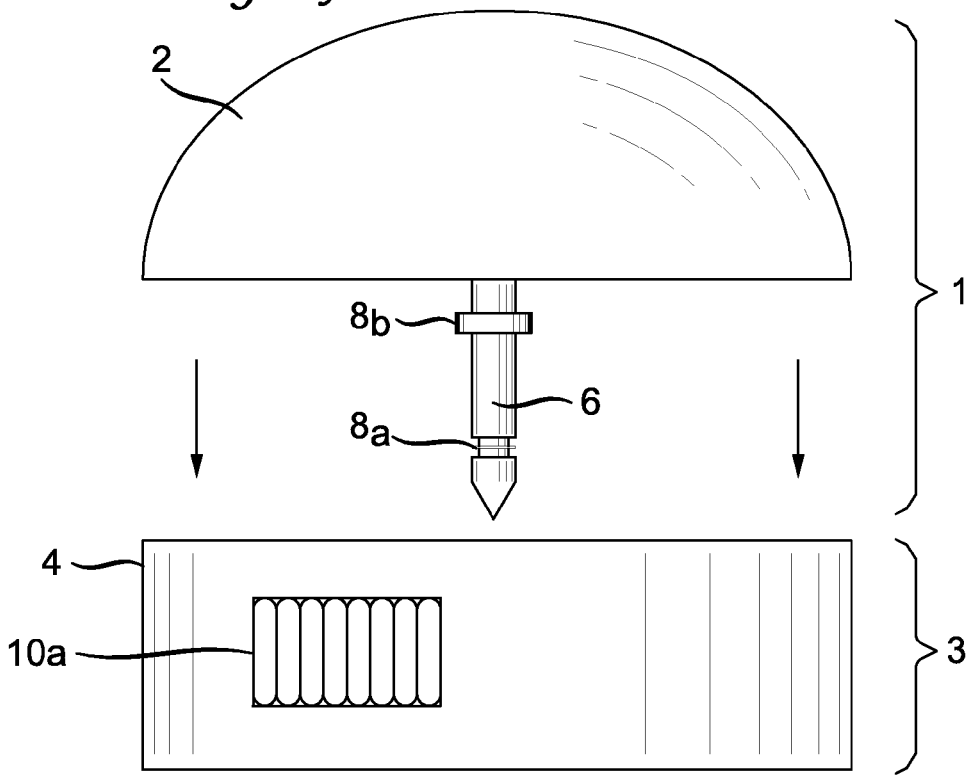
FIG. 1A is a side elevation view of a configuration of a button in accordance with an embodiment of the present invention.

FIG. 1A is a side elevation view of a configuration of a button in accordance with an embodiment of the present invention. The button includes a pin 1 and a base 3. The pin 1 includes a head 2 and a stem 6, and the base 3 includes a case 4, which receives the stem 6 of the pin 1. In one embodiment, the case includes a top surface (reference 38 of FIG. 4) having an opening (reference 30 of FIG. 4) through which the stem 6 is received.

The button can include a mechanism for controlling the depth to which the stem 6 is inserted into the case 4, thereby determining the size of a gap 5 between the bottom of the head 2 of the pin 1 and the top surface of the case 4. For example, the stem 6 can include a ridged portion 8*a* near the tip of the stem 6 that is captured by a mechanism contained within the case 4, such that once the ridged portion 8*a* is captured, the stem 6 cannot be further inserted into the case 4. Release button 10*a* engages the mechanism inside the case 4, and provides an external interface for the user to interact with and control the mechanism. The mechanism for controlling the depth of the stem 6 is discussed in more detail below with respect to FIGS. 3 and 4.

Figure 1B:
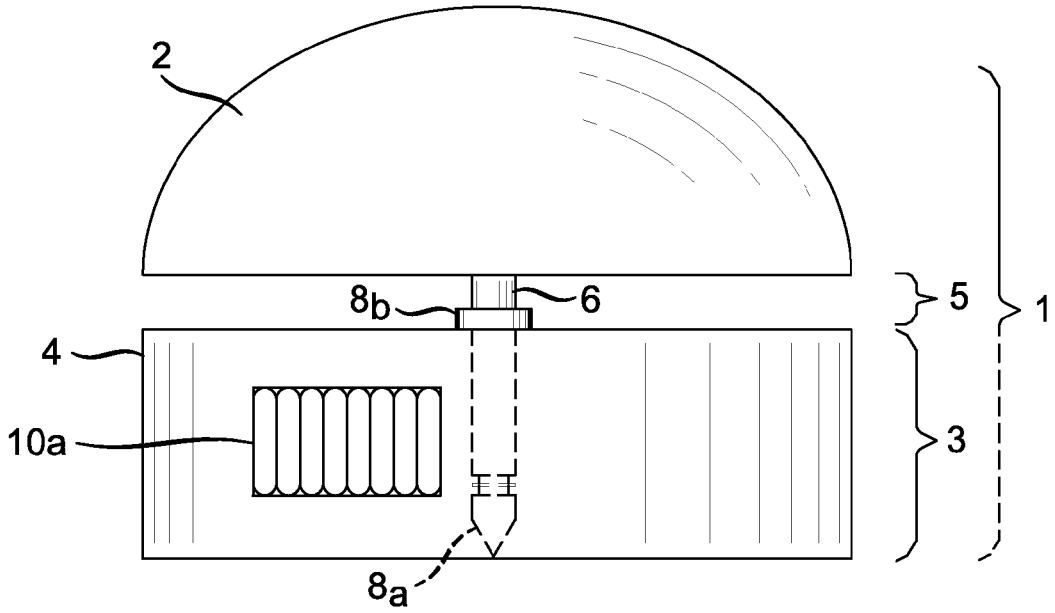
FIG. 1B is a side elevation view of a further configuration of a button in accordance with an embodiment of the present invention.

The depth of insertion of the stem 6 into the case 4 can also be controlled by a flange 8*b* that contacts the top surface 38 of the case 4 if the stem 6 of the pin 1 is inserted into the case 4 to a predetermined depth. FIG. 1B is a side elevation view of a configuration of the button in accordance with an embodiment of the present invention, in which the stem 6 of the pin 1 is inserted in the case 4. As illustrated, in FIG. 1B, the stem 6 is inserted into the case 4 to a predetermined depth, which is determined by the placement of the flange 8*b* on the stem 6. The placement of the flange 8*b* determines the size of the gap 5 between the case 4 and the bottom of the head 2 of the pin 1. Additionally, as illustrated by the dashed lines of the stem 6, it should be noted that the depth of insertion of the stem 6 can be controlled by the contact of the tip of the stem 6 with a bottom surface (item 12, FIGS. 2 and 4) of the case 4.

As applied to a shirt as a button, the stem 6 is configured to pierce through a fabric or other material where the button is to be located. The stem 6 is then inserted into the case 4 such that the head 2 is on one side of the fabric and the case 4 is on the other. The gap 5 is the space that accommodates the fabric surrounding buttonhole. If the gap 5 were too short, it may be difficult to button a garment. Additionally, the portion of fabric on which the button is being replaced, is compressed, and held flat between the flange 8*b* and the top surface 38 of the case 4, thus reducing axial movement of the stem 6 protruding through the fabric, and thereby reducing wear on the fabric.

Figure 2:
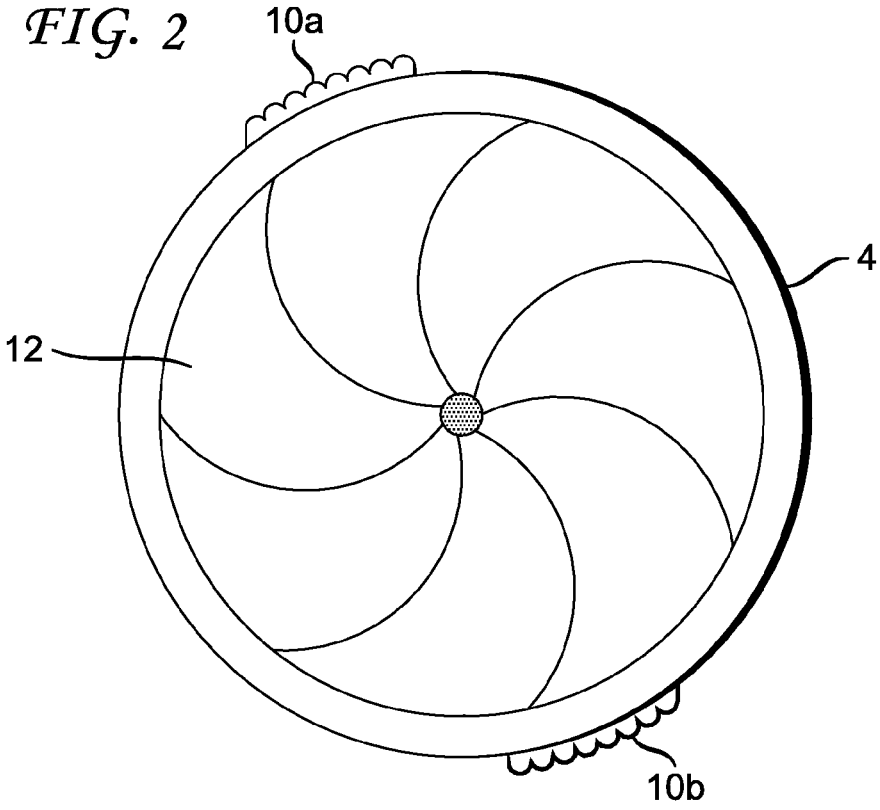
FIG. 2 is a bottom plan view of a button in accordance with an embodiment of the present invention.

FIG. 2 is a bottom plan view of a button in accordance with an embodiment of the present invention. As illustrated, the case 4 includes a bottom surface 12. The bottom surface 12 can include a decorative pattern for ornamentation. Additionally, the bottom surface 12 can be solid (i.e., having no holes or openings) or include a solid portion disposed such that the stem 6 of the pin 1 cannot pass through the case 4. As noted above, a solid bottom surface 12 controls the depth of insertion of the stem 6 into the case 4. Additionally, the solid surface 12 of the case 4 protects a wearer of the button from being injured by the stem 6. That is, because the stem 6 can include a pointed end to facilitate piercing the fabric of the garment, the stem 6 can be dangerous and/or painful if it passed through the case 4, where it could pierce the skin of the wearer.

In the view of the button illustrated in FIG. 2, it can be seen that, two release buttons 10*a* and 10*b* can be used to engage the internal mechanism retaining the stem 6 in the case 4. As discussed below, each of the release buttons 10*a* and 10*b* can be depressed to engage the capture and release mechanism of the button. The release buttons 10*a* and 10*b* can be aligned such that, as the release buttons 10*a* and 10*b* are depressed, their respective displacement is substantially towards one another.

Figure 3:
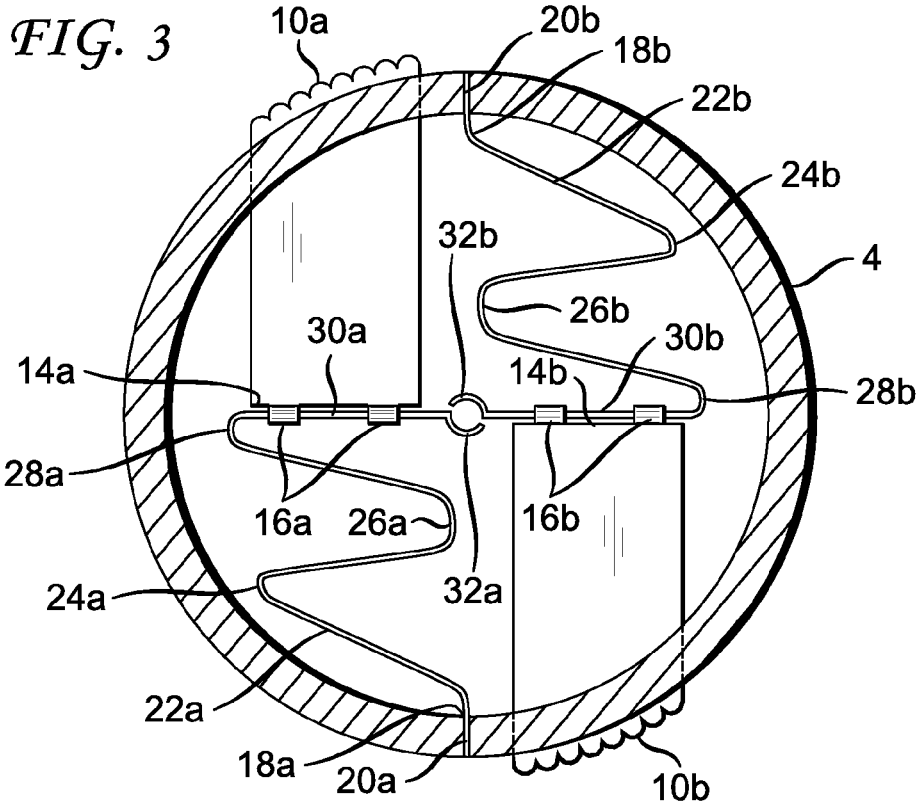
FIG. 3 is a cross-section of the base of a button in accordance with an embodiment of the present invention.

FIG. 3 is a cross-section of the base of a button in accordance with an embodiment of the present invention and illustrates the mechanism for securing the stem within the case 4 is illustrated. Specifically, the stem 6 can be secured using a spring 22*a*. The spring is coupled to the case 4 at a first end 18*a*. The opposing end of the spring includes an engagement-portion 32*a* which holds the stem 6 in place when inserted into the case. The engagement-portion 32*a* can hold the stem 6 in place by applying a force against the stem 6 that results in a friction force resisting removal of the stem 6 from the case 4.

Alternatively, the engagement-portion 32*a*, can engage the ridged portion 8*a* of the stem 6, such that the engagement-portion 32*a* sits within a depression (e.g., between two peaks) of the ridged portion 8*a*. Thus, if a wearer of the button attempts to remove the stem 6 from the case 4, the engagement-portion 32*a* will apply a direct force against a peak of the ridged portion 32*a* thereby resisting removal of the stem 6 from the case 4.

When the engagement-portion 32*a* is seated within a depression of the ridged portion 8*a*, the engagement-portion 32*a* of the spring 22*a* also controls the depth of insertion of the stem 6 into the case 4. That is, when the engagement-portion 32*a* is seated within a depression of the ridged portion, the engagement-portion 32*a* will apply a direct force against an upper peak (i.e., a peak closer to the head 2 of the pin 1) of the ridged portion, thereby resisting insertion of the stem 6 into the case 4 beyond the depth at which the engagement-portion 32*a* is seated within the ridged portion 8*a*.

The spring 22*a* can be formed from a strip of material, such as a metal or plastic, and can include a number of flex-segments. Each flex-segment increases flexibility of the spring 22*a* and controls the direction of displacement of the engagement-portion 32*a* as the spring compresses or expands. As illustrated, spring 22*a* includes flex-segments 18*a*, 24*a*, 26*a*, and 28*a*. Each flex-segment 18*a*, 24*a*, 26*a*, and 28*a* is a bent portion of the spring 22*a*.

The spring 22*a* is coupled at one end to the case 4 at anchor 20*a*. Substantially adjacent the engagement-portion 32*a*, release button 10*a* is attached to a second end 30*a* of the spring 22*a* by clips 16*a*. The spring 22*a* is compressed as the user presses (i.e., exerts a force against) release button 10*a*. The force is transferred by surface 14*a* of the release button 10*a* to a second end 30*a* of the spring 22*a*, thereby displacing the second end 30*a* toward the first end of the spring 22*a* at anchor 20*a* (i.e., compressing the spring). As the user removes the force from release button 10*a*, the spring 22*a* expands, until the engagement-portion 32*a* contacts the stem 6, if the pin 1 is inserted. The flex-segments are located to minimize movement of the second end 30*a* transverse to the direction of displacement of the release button 10*a* as the spring compresses or expands. That is, the location and number of flex-segments are such that the second end 30*a* and engagement-portion 32*a* move substantially along a straight path between the anchor 20*a* and the release button 10*a*.

The mechanism for securing the stem 6 of the pin 1 within the case 4 can include a second spring 22*b*, that is identical to the first spring 22*a*. Because spring 22*b* is identical to spring 22*a*, it includes corresponding components and features such as: anchor 20*b*; flex-segments 18*b*, 24*b*, 26*b*, and 28*b*; second end 30*b*; and engagement-portion 32*b*. Additionally, the mechanism can include a second release button 10*b*, having surface 14*b* and clips 16*b*. Release button 10*b* is coupled to spring 22*b* in the same configuration as spring 22*a* and release button 10*a* described above. Additionally, spring 22*b* engages the stem 6 in the manner described above with respect to spring 22*a*. FIG. 3 illustrates both springs 22*a* and 22*b*.

Springs 22*a* and 22*b* oppose one another such that the force exerted by on spring substantially opposes the force exerted by the other spring. In this manner, stem 6 can be pinched between the two springs. Additionally, because springs 22*a* and 22*b* are anchored on opposite sides of the case 4, and release buttons 10*a* and 10*b* are positioned on opposite sides of the case 4, the user can easily pinch release buttons 10*a* and 10*b* to disengage engagement-portions 32*a* and 32*b* and release the stem 6 from the case 4.

Figure 4:
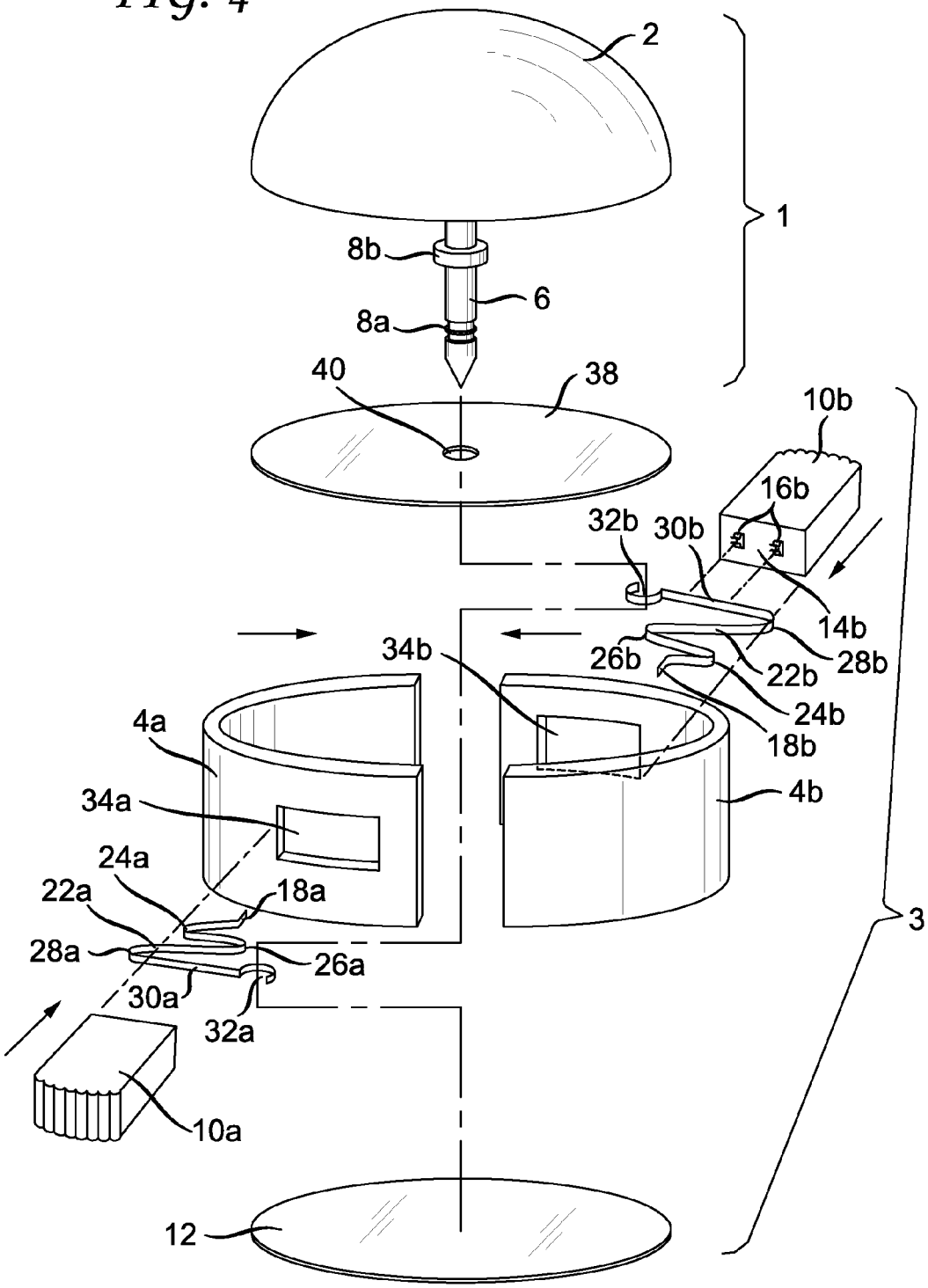
FIG. 4 is a exploded view of a button in accordance with an embodiment of the present invention.

FIG. 4 is an exploded view of a button in accordance with an embodiment of the present invention. As illustrated, base 3 includes a case comprising top surface 38, bottom surface 12, and sides 4*a* and 4*b*, which define a cavity in which the retaining mechanism of springs 22*a* and 22*b* is housed. Release buttons 10*a* and 10*b* are connected to springs 22*a* and 22*b* respectively, by attaching clips 16*a* and 16*b* to the respective second ends 30*a* and 30*b*.

A person of ordinary skill in the art will recognize the manufacturing efficiencies that can be achieved by the button described above. Various components of the base 3 are identical, but used in multiple locations, such as springs 22*a* and 22*b*, release buttons 10*a* and 10*b*, and clips 16*a* and 16*b*. Bottom surface 12 and top surface 38 are also identical, except for hole 40 through top surface 38, which could be manufactured by drilling a hole 40 through bottom surface 12. Additionally, case 4 is divided into two identical halves 4*a* and 4*b*. Each half 4*a* and 4*b* includes a respective opening 34*a* and 34*b* through with release buttons 10*a* and 10*b* are inserted. Thus, the button design requires reduced parts machining and manufacturing. Additionally, assembly is simplified by the number of parts and duplication of fittings.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention. The various functional modules that are shown are for illustrative purposes only, and may be combined, rearranged and/or otherwise modified.

I claim:

1. An apparatus for replacing a button of a shirt, comprising:

a pin comprising a head configured to engage a button hole of the shirt, and a stem having a first end fixedly attached to the head and a second end longitudinally opposing the first end and configured to pass through a fabric of the shirt; and a base configured to receive the stem, the base comprising:

a case comprising an open top and an open bottom, the case comprising a first opening and a second opening in a wall of the case, the first opening offset from a center of the case in a first direction, the second opening offset from the center of the case in a second direction, the first direction opposite the second direction;

a top surface covering the open top of the case, the top surface having an opening through which the stem is received;

a bottom surface covering the open bottom of the case;

a first spring comprising a first plurality of flex segments, a first end, a second end, and an engagement portion extending from the second end of the first spring, wherein the first end of the first spring is anchored to the wall of the case in a first location opposite the first opening;

a second spring comprising a second plurality of flex segments, a first end, a second end, and an engagement portion extending from the second end of the second spring, wherein the first end of the second spring is anchored to the wall of the case in a second location opposite the second opening;

a first release button having clips engaging the second end of the first spring, the first release button inserted in the first opening; and a second release button having clips engaging the second end of the second spring, the second release button inserted in the second opening, wherein the engagement portion of the first spring is forced toward the engagement portion of the second spring by the first spring and the engagement portion of the second spring is forced toward the engagement portion of the first spring by the second spring, the engagement portion of the first spring and the engagement portion of the second spring configured to frictionally retain the pin, the first release button and the second release button each travelling along linear paths parallel to each other, in response to pinching by a user, based on the configuration of the first opening and the second opening, respectively, and being fixed to the first spring and the second spring, respectively.

2. The apparatus of claim 1, wherein the base comprises means for limiting a depth of insertion of the stem into the base.

3. The apparatus of claim 1, wherein the head of the pin resembles a shirt button.

4. An apparatus comprising:

a pin comprising a head and a stem having a first end fixedly attached to the head and a second end longitudinally opposing the first end, the stem being substantially perpendicular to the head; and a base comprising:

a case having a cavity defined by a top surface including an opening for receiving the second end of the stem and a side surface coupled to the top surface, the case having a first opening and a second opening in the side surface of the case, the first opening offset from a center of the case in a first direction, the second opening offset from the center of the case in a second direction, the first direction opposite the second direction, a first spring disposed with the cavity of the case, the first spring comprising a first plurality of flex segments, a first end coupled to the case a second end, and an engagement portion extending from the second end of the first spring;

a second spring comprising a second plurality of flex segments, a first end, a second end, and an engagement portion extending from the second end of the second spring, wherein the first end of the second spring is coupled to the case in a second location opposite the second opening;

a first release button having clips engaging the second end of the first spring, the first release button inserted into the first opening; and a second release button having clips engaging the second end of the second spring, the second release button inserted in the second opening, wherein the engagement portion of the first spring is forced toward the engagement portion of the second spring by the first spring and the engagement portion of the second spring is forced toward the engagement portion of the first spring by the second spring, the engagement portion of the first spring and the engagement portion of the second spring configured to frictionally retain the pin, the first release button and the second release button each travelling along a linear path parallel to each another by the first opening and the second opening, respectively, and being fixed to the first spring and the second spring, respectively.

5. The apparatus of claim 4, wherein the stem of the pin further comprises a ridged portion disposed near the second end, and the second end of the first spring is configured to engage the ridged portion of the stem.

6. The apparatus of claim 4, wherein the base further comprises a bottom surface coupled to the side surface having a solid portion disposed so as to prevent the stem from passing through bottom surface.

7. The apparatus of claim 4, wherein the head of the pin resembles a shirt button.

8. A base for securing a stem of a pin comprising:

a case comprising an open top and an open bottom, the case comprising a first opening and a second opening in a wall of the case, the first opening offset from a center of the case in a first direction, the second opening offset from the center of the case in a second direction, the first direction opposite the second direction;

a top surface covering the open top of the case, the top surface having an opening through which the stem is received;

a bottom surface covering the open bottom of the case;

a first spring comprising a first plurality of flex segments, a first end, a second end, and an engagement portion extending from the second end of the first spring, wherein the first end of the first spring is anchored to the wall of the case in a first location opposite the first opening;

a second spring comprising a second plurality of flex segments, a first end, a second end, and an engagement portion extending from the second end of the second spring, wherein the first end of the second spring is anchored to the wall of the case in a second location opposite the second opening;

a first release button having clips engaging the second end of the first spring, the first release button inserted in the first opening; and a second release button having clips engaging the second end of the second spring, the second release button inserted in the second opening, wherein the engagement portion of the first spring is forced toward the engagement portion of the second spring by the first spring and the engagement portion of the second spring is forced toward the engagement portion of the first spring by the second spring, the engagement portion of the first spring and the engagement portion of the second spring configured to frictionally retain the pin, the first release button and the second release button each travelling along linear paths parallel to each other, in response to pinching by a user, based on the configuration of the first opening and the second opening, respectively, and being fixed to the first spring and the second spring, respectively.

9. The base of claim 8, wherein the bottom surface comprises a solid portion disposed so as to prevent the stem from passing through the bottom surface.

* * * * *